US012800145B2

(12) United States Patent
Won et al.

(10) Patent No.: US 12,800,145 B2
(45) Date of Patent: Nov. 17, 2026

(54) SCRUBBING APPARATUS

(71) Applicant: SAMSUNG ELECTRONICS CO., LTD., Suwon-si (KR)

(72) Inventors: Inho Won, Suwon-si (KR); Juhyun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 769 days.

(21) Appl. No.: 18/202,008

(22) Filed: May 25, 2023

(65) Prior Publication Data

US 2024/0053004 A1 Feb. 15, 2024

(30) Foreign Application Priority Data

Aug. 12, 2022 (KR) ..... 10-2022-0101169

(51) Int. Cl.
*F23G 5/08* (2006.01)
*F23G 5/44* (2006.01)
*F23G 7/06* (2006.01)

(52) U.S. Cl.
CPC ..... *F23G 7/06* (2013.01); *F23G 2207/50* (2013.01); *F23G 2209/14* (2013.01)

(58) Field of Classification Search
CPC ..... F23G 5/08; F23G 5/44; F23G 7/06
See application file for complete search history.

(56) References Cited

U.S. PATENT DOCUMENTS 5,649,985 A * 7/1997 Imamura ..... B01D 53/58 96/275
2003/0026743 A1* 2/2003 Imamura ..... B01D 53/68 422/171
2004/0255779 A1* 12/2004 Trivett ..... B01D 53/18 95/226
2012/0100491 A1* 4/2012 Mori ..... B01D 53/77 204/247

FOREIGN PATENT DOCUMENTS

KR 10-2005-0041933 A 5/2005
KR 20050041933 A * 5/2005 ..... H10P 72/0431
KR 10-2005-0116247 A 12/2005
KR 10-2010-0017043 A 2/2010
KR 10-1270961 B1 6/2013

(Continued)

*Primary Examiner* — Randy Boyer
(74) *Attorney, Agent, or Firm* — Sughrue Mion, PLLC

(57) ABSTRACT

A scrubbing apparatus includes a reactor including an interior space, a burner disposed in the interior space of the reactor and configured to burn waste gas, a water tower connected to the reactor and configure to remove harmful substances from combusted gas, a discharge pipe connected to an upper end of the water tower, through which a fluid discharged from the water tower is configured to flow, and a heat exchanger surrounding the discharge pipe and configure to remove moisture from an inside of the discharge pipe. The heat exchanger includes a heat exchanger body including a cooling passage through which a cooling fluid performing heat exchange with gas flowing through the discharge pipe is configured to flow, a heat sink disposed between the heat exchanger body and the discharge pipe, and an insulator surrounding at least a portion of an external surface of the heat exchanger body.

20 Claims, 8 Drawing Sheets

(56) References Cited

FOREIGN PATENT DOCUMENTS

| | | | |
|---|---|---|---|
| KR | 10-1328500 | B1 | 11/2013 |
| KR | 10-1413747 | B1 | 7/2014 |
| KR | 10-1413750 | B1 | 7/2014 |
| KR | 10-1458999 | B1 | 11/2014 |
| KR | 10-1508972 | B1 | 4/2015 |
| KR | 10-2016-0019375 | A | 2/2016 |
| KR | 10-1619242 | B1 | 5/2016 |
| KR | 10-2017-0028653 | A | 3/2017 |
| KR | 10-2020-0108711 | A | 9/2020 |
| KR | 10-2020-0108712 | A | 9/2020 |

* cited by examiner

SCRUBBING APPARATUS

CROSS-REFERENCE TO RELATED APPLICATION(S)

This application claims priority to Korean Patent Application No. 10-2022-0101169, filed on Aug. 12, 2022, in the Korean Intellectual Property Office, the disclosure of which is incorporated by reference herein in its entirety.

BACKGROUND

The present disclosure relates to a scrubbing apparatus.

A scrubbing apparatus may be used to treat harmful waste gases emitted from semiconductor manufacturing facilities after semiconductor processing.

A burn-wet type scrubbing apparatus oxidizes harmful gases emitted from semiconductor manufacturing facilities through a burner, and then neutralizes the adsorbed by-products generated through oxidation with alkaline water and discharges the same in the form of wastewater and purified gas.

In addition, the exhaust gas oxidized in the burner may be humidified by droplets in the upper part of the primary reactor, humidified in the secondary wet column, and may then flow through an exhaust pipe.

Since the length of the exhaust pipe is long, and the hot and humid exhaust gas flowing along the exhaust pipe may deliver the by-products mixed with the exhaust gas to an arbitrary location, there may be a problem in that the flow is condensed due to cooling in the stagnant area and then accumulated to block the exhaust pipe.

Furthermore, the by-products and water vapor combine to form an acidic solution, and in this case, there may be a problem of accelerating corrosion of the exhaust pipe in a certain area of the exhaust pipe.

SUMMARY

One or more example embodiments provide a scrubbing apparatus capable of preventing clogging of a discharge pipe by performing dehumidification inside the discharge pipe.

One or more example embodiments provide a scrubbing apparatus capable of preventing accelerated corrosion of a discharge pipe in a certain area of the discharge pipe.

According to an aspect of an example embodiment, a scrubbing apparatus includes: a reactor comprising an interior space; a burner disposed in the interior space of the reactor and configured to burn waste gas; a water tower connected to the reactor and configured to remove harmful substances from combusted gas; a discharge pipe connected to an upper end of the water tower, through which a fluid discharged from the water tower is configured to flow; and a heat exchanger surrounding the discharge pipe and configured to remove moisture from an inside of the discharge pipe, wherein the heat exchanger comprises: a heat exchanger body comprising a cooling passage through which a cooling fluid performing heat exchange with the fluid flowing through the discharge pipe is configured to flow; a heat sink disposed between the heat exchanger body and the discharge pipe and in close contact with an external surface of the discharge pipe; and an insulator surrounding at least a portion of an external surface of the heat exchanger body.

According to an aspect of an example embodiment, a scrubbing apparatus includes: a reactor comprising an interior space; a burner disposed in the interior space of the reactor and configure to burn waste gas; a water tower connected to the reactor and configured to remove harmful substances from combusted gas; and a discharge pipe connected to an upper end of the water tower; and a heat exchanger comprising a tube shape corresponding to a shape of the discharge pipe and surrounding the discharge pipe, wherein the heat exchanger comprises: a heat exchanger body comprising a cooling passage through which a cooling fluid performing heat exchange with a fluid flowing through the discharge pipe is configured to flow; a heat sink disposed between the heat exchanger body and the discharge pipe and in close contact with an external surface of the discharge pipe; and an insulator surrounding at least a portion of an external surface of the heat exchanger body, and when a number of the cooling passage of the heat exchanger body is n, a radius of the cooling passage is r, and a radius of an inner diameter of the heat exchanger body is R, $R<nr/2$ ($5\leq n\leq 20$) is satisfied.

According to an aspect of an example embodiment, a scrubbing apparatus includes: a reactor comprising an interior space; a burner disposed in the interior space of the reactor and configured to burn waste gas; a water tower connected to the reactor and configured to remove harmful substances from combusted gas; a discharge pipe connected to an upper end of the water tower; and a heat exchanger surrounding the discharge pipe, wherein the heat exchanger comprises: a heat exchanger body comprising a plurality of cooling passages extending in a longitudinal direction and spaced apart from each other in a circumferential direction; a heat sink disposed between the heat exchanger body and the discharge pipe; and an insulator surrounding at least a portion of an external surface of the heat exchanger body.

BRIEF DESCRIPTION OF DRAWINGS

The above and other aspects and features will be more apparent from the following description, taken in conjunction with the accompanying drawings, in which.

DETAILED DESCRIPTION

Example embodiments will be described more fully with reference to the accompanying drawings, in which example embodiments are shown. Embodiments described herein are provided as examples, and thus, the present disclosure is not limited thereto, and may be realized in various other forms. Each example embodiment provided in the following description is not excluded from being associated with one or more features of another example or another example embodiment also provided herein or not provided herein but consistent with the present disclosure. It will be understood that when an element or layer is referred to as being "on," "connected to" or "coupled to" another element or layer, it can be directly on, connected or coupled to the other element or layer, or intervening elements or layers may be present. By contrast, when an element is referred to as being "directly on," "directly connected to" or "directly coupled to" another element or layer, there are no intervening elements or layers present. Expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

Figure 1:
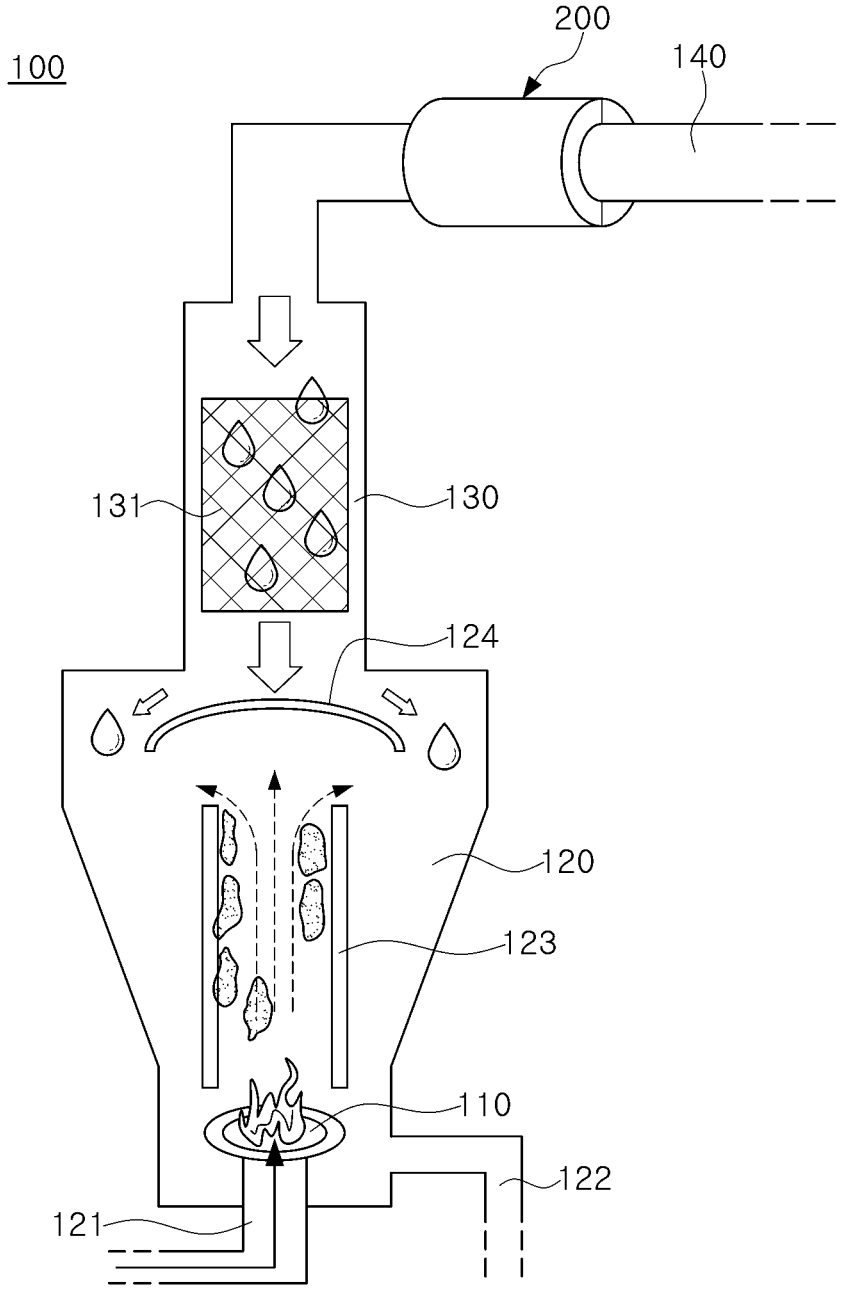
FIG. 1 is a block diagram illustrating a scrubbing apparatus according to an example embodiment.

FIG. 1 is a block diagram illustrating a scrubbing apparatus according to an example embodiment.

Referring to FIG. 1, a scrubbing apparatus 100 according to an example embodiment includes a burner 110, a reactor 120, a water tower 130, a discharge pipe 140, and a heat exchanger 200.

The scrubbing apparatus 100 may be a burn-wet type device that primarily burns waste gas in the reactor 120 and receives by-products using treated water.

The burner 110 of the example embodiment is disposed in the interior space of the reactor 120. The burner 110 performs the role of a primary combustion of the waste gas flowing into the reactor 120. To this end, the burner 110 may be disposed in the lower end of the interior space of the reactor 120.

The reactor 120 has an interior space. The reactor 120 may be provided with an inlet 121 through which waste gas flows into the burner 110 disposed at the lower end, for example. In addition, the reactor 120 may be provided with an outlet 122 discharging the aqueous solution containing by-products. The reactor 120 may be provided with a guide member 123 disposed above the burner 110 and guiding the burned gas to flow toward the upper side. Accordingly, the gas combusted by the burner 110 may flow through the inside of the guide member 123 to flow toward the upper end of the reactor 120. In addition, the reactor 120 may be provided with a cover member 124 for preventing the treated water flowing in from the water tower 130 from falling onto the burner 110 and instead diverting the treated water to either side of the burner 110. Accordingly, the treated water flowing in from the water tower 130 is blocked by the cover member 124 and flows in the edge of the reactor 120.

The water tower 130 is disposed in the upper part of the reactor 120, and serves to absorb the combustion gas by droplets and then collect the absorbed gas in a filter 131. For example, the filter 131 is disposed in the longitudinal direction of the water tower 130 to collect substances contained in the combustion gas absorbed by the droplets. In addition, an injection nozzle (not illustrated) injecting droplets for absorbing combustion gas may be provided at the upper end of the water tower 130, for example, at the upper portion of the filter 131. The injection nozzle may be provided as a plurality of injection nozzles.

The discharge pipe 140 extends from the upper end of the water tower 130 and provides a flow path through which the gas from which harmful substances have been removed flows.

The heat exchanger 200 is installed on the discharge pipe 140 to lower the humidity inside the discharge pipe 140. A further description of the heat exchanger 200 will be described later.

Figure 2:
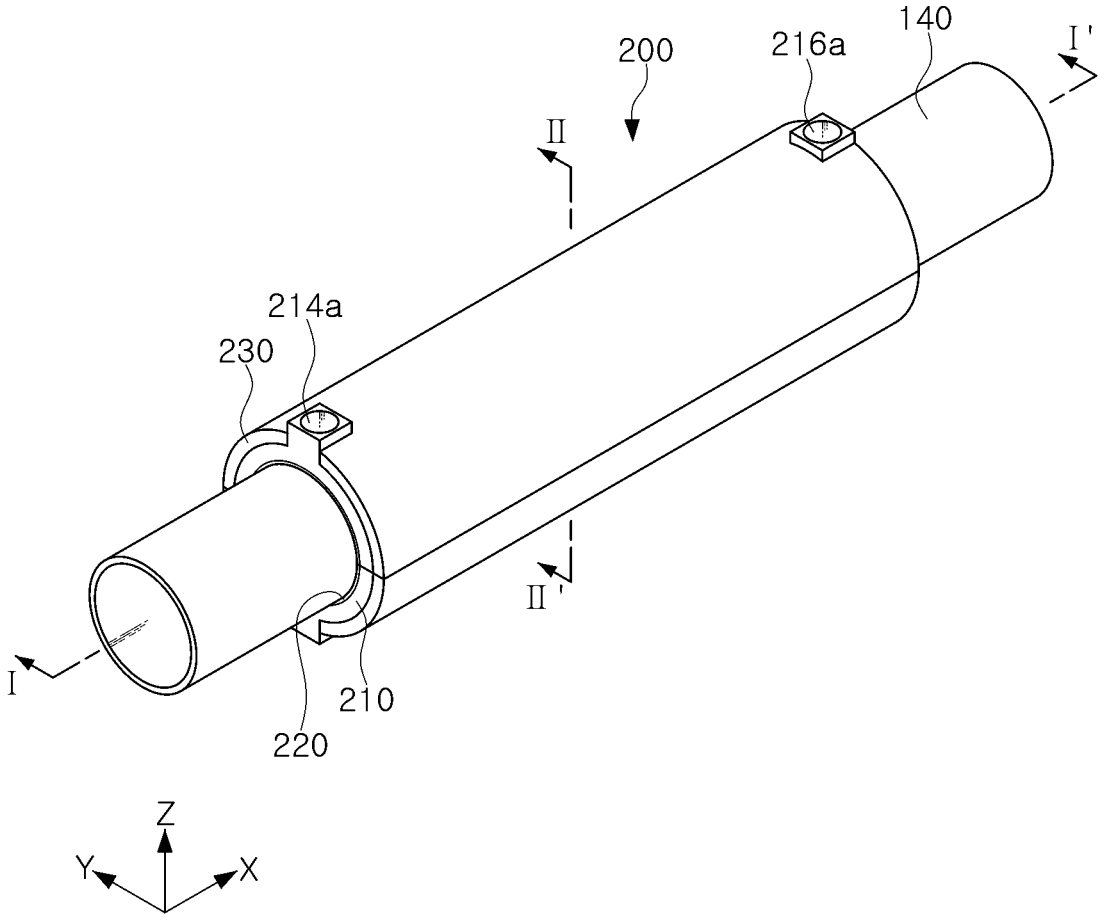
FIG. 2 is a perspective view illustrating a heat exchanger provided on a scrubbing apparatus according to an example embodiment.
Figure 3:
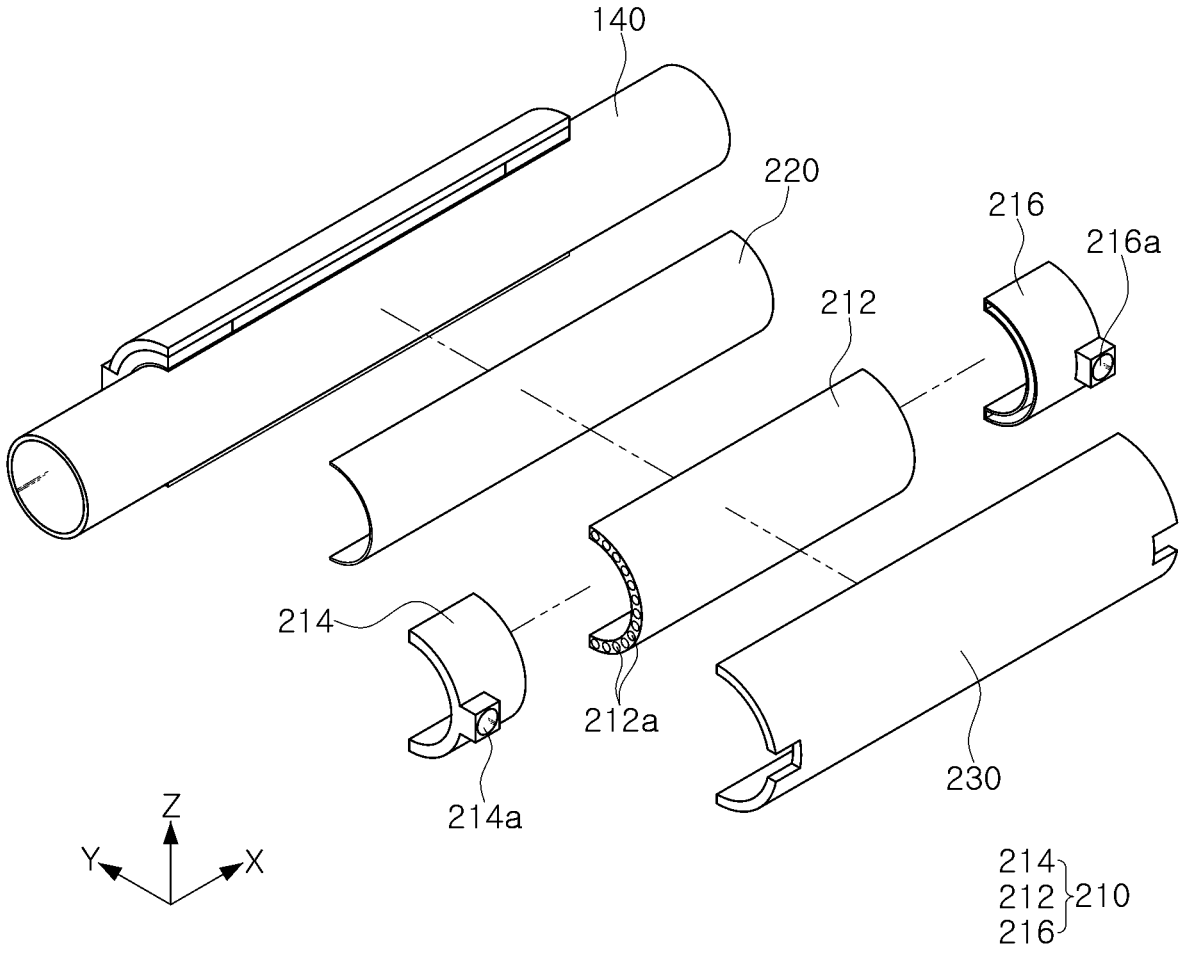
FIG. 3 is an exploded perspective view illustrating a heat exchanger provided in a scrubbing apparatus according to an example embodiment.
Figure 4:
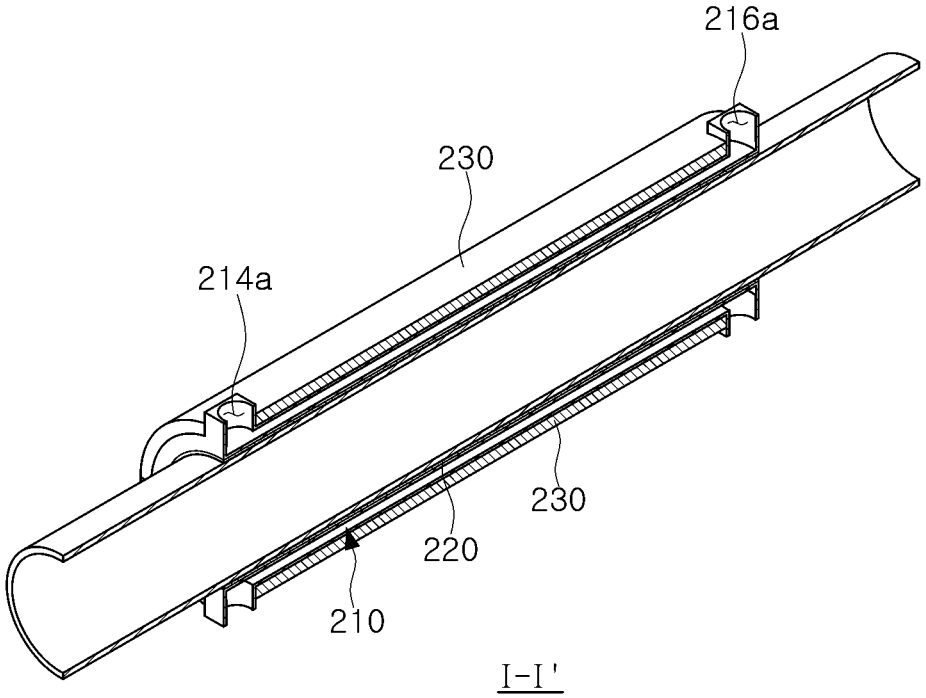
FIG. 4 is a cross-sectional view taken along line I-I' of FIG. 2.
Figure 5:
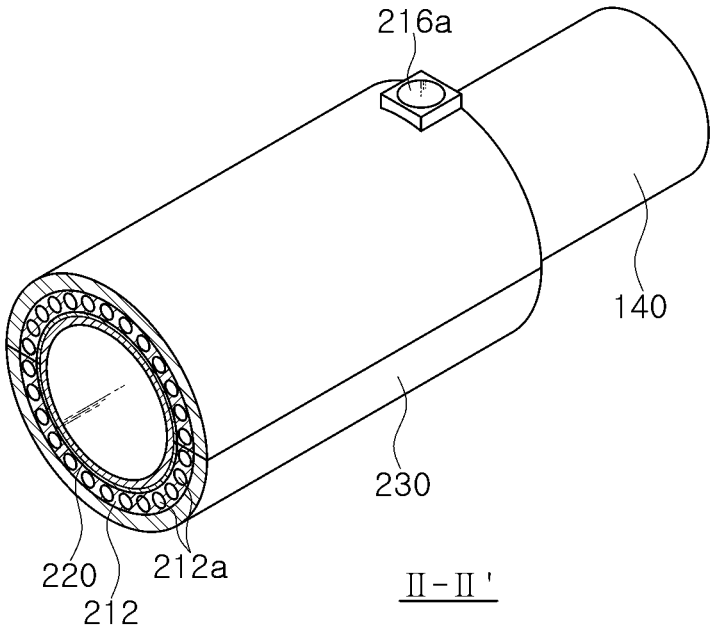
FIG. 5 is a cross-sectional view taken along line II-IF of FIG. 2.

FIG. 2 is a perspective view illustrating a heat exchanger provided in the scrubbing apparatus according to an example embodiment, FIG. 3 is an exploded perspective view illustrating the heat exchanger provided in the scrubbing apparatus according to an example embodiment, FIG. 4 is a cross-sectional view taken along line I-I' of FIG. 2, and FIG. 5 is a cross-sectional view taken along line II-IF of FIG. 2.

Referring to FIGS. 2 to 5, the heat exchanger 200 may include, for example, a heat exchanger body 210, a heat sink 220, and a heat insulator 230.

The heat exchanger body 210 may have a tube shape corresponding to the shape of the discharge pipe 140. In the example embodiment, the heat exchanger body 210 has a circular tube shape to correspond to the shape of the discharge pipe 140 is illustrated as an example, but the example embodiment is not limited thereto. For example, when the shape of the discharge pipe 140 is a rectangular tube shape, the heat exchanger body 210 may also have a rectangular tube shape.

The heat exchanger body 210 may include, for example, a body portion 212 provided with a plurality of cooling passages 212*a*, a first cover 214 disposed on one end of the body portion 212 and provided with an inlet 214*a*, and a second cover 216 disposed on the other end of the body portion 212 and provided with an outlet 216*a*.

The cooling passage 212*a* may be disposed in the longitudinal direction of the body portion 212, for example, in the X-axis direction of FIG. 2. The cooling passage 212*a* may include a plurality of cooling passages 212*a* spaced apart from each other in the circumferential direction. In this case, the circumferential direction indicates a direction of rotation along the inner surface of the body portion 212 or the external surface of the body portion 212, and a direction of rotation about the X axis of FIG. 2.

Also, although not illustrated in the drawing, one or more grooves may be formed in the cooling passage 212*a* to increase the contact area between the cooling fluid and the body portion 212. The groove may be formed to have a spiral shape along the inner surface of the cooling passage 212*a*, may also be formed to have a straight shape in the longitudinal direction of the body portion 212 or a combination of both, for example.

In addition, the cross-section of the cooling passage 212*a* may be changed into various shapes, such as a circular shape, a polygonal shape, or an elliptical shape.

A buffer space may be formed in the first cover 214 such that the cooling fluid introduced through the inlet 214*a* may be uniformly provided to the cooling passage 212*a*. In addition, a buffer space may be formed in the second cover 216 to allow a uniform amount of the cooling fluid to flow out through the outlet 216*a*.

The body portion 212, the first cover 214, and the second cover 216 may be integrally molded or manufactured separately and joined by welding, for example.

As an example, the heat exchanger body 210, for example, the body portion 212, the first cover 214, and the second cover 216 may be formed of a light aluminum material having a high heat conductivity coefficient to improve heat transfer efficiency. In addition, the heat exchanger body 210 may have a length of 500 mm or less in the X-axis direction to prevent a decrease in heat exchange efficiency with the discharge pipe 140.

The inlet 214*a* and the outlet 216*a* of the heat exchanger body 210 may be connected to a Power supply Cooling Water system (PCW System) provided in a semiconductor factory and connected to a semiconductor facility. Accordingly, heat exchange with the discharge pipe 140 may be performed while cooling water flows through the cooling passage 212*a* of the heat exchanger body 210. In this case, even if a separate cooling cycle is not configured, since the discharge pipe 140 may be cooled, installation costs and the like may be reduced. In detail, as the heat exchanger body 210 is connected to the power supply cooling water system provided in the semiconductor factory, the heat exchanger 200 may be installed on the discharge pipe 140 more simply.

Figure 6:
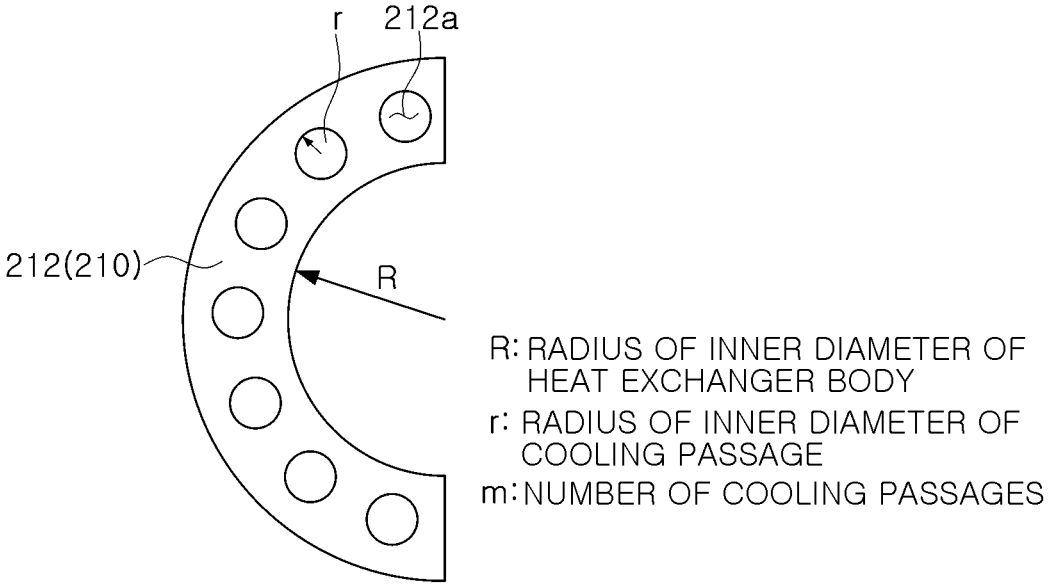
FIG. 6 is a schematic diagram illustrating a radius of a cooling passage of a heat exchanger, a radius of an inner diameter of a heat exchanger body, and the number of cooling passages.

In addition, according to an example embodiment, the length of the heat exchanger body 210, for example, the length in the X-axis direction may be 500 mm or less. In a case in which the length of the heat exchanger body 210 is more than 500 mm, the heat transfer efficiency between the heat exchanger body 210 and the fluid flowing in the discharge pipe 140 may be lowered. In an example embodiment, looking at the relationship between the number of cooling passages 212*a* of the heat exchanger body 210, the radius of the cooling passages 212*a*, and the inner diameter of the heat exchanger body 210, as illustrated in FIG. 6, when the inner diameter of the heat exchanger body 210 is defined as R, the radius of the cooling passage 212*a* is defined as r, and the number of the cooling passages 212*a* is defined as n, the following equation may be satisfied:

$$R<nr/2\ (5\leq n\leq 20)$$

As the heat exchanger body 210 of an example embodiment may be configured to satisfy the above relational expression, heat transfer efficiency may be further improved.

Figure 7:
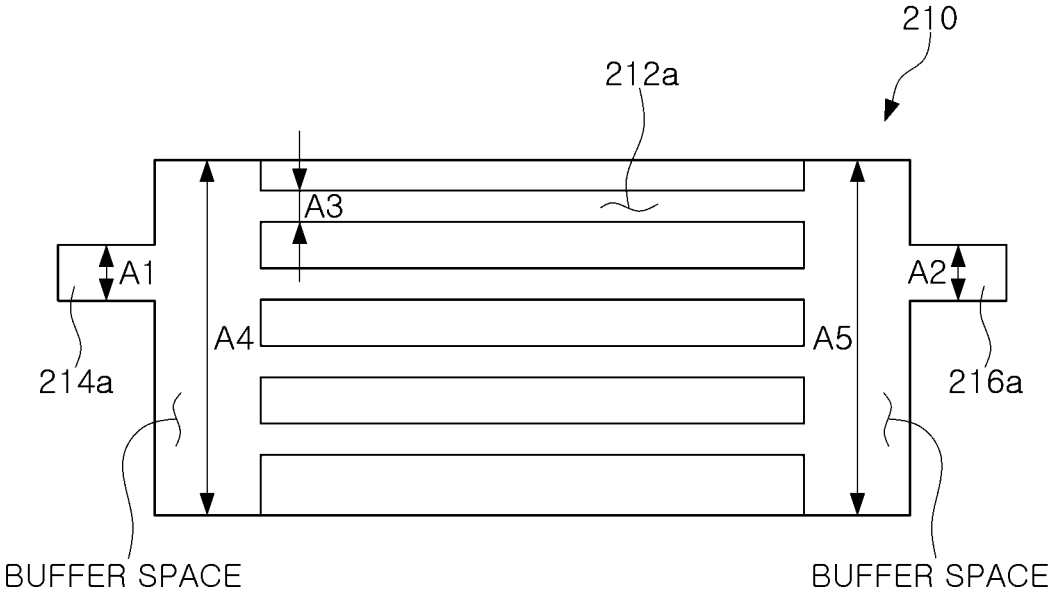
FIG. 7 is a schematic diagram illustrating the relationship between cross-sectional areas in respective regions of a heat exchanger.

Looking at the relationship between the buffer space formed in the first cover 214 and the second cover 216, as illustrated in FIG. 7, when the cross-sectional area of the inlet 214*a* is A1, the cross-sectional area of the outlet 216*a* is A2, the cross-sectional area of the buffer space of the first cover 214 is A4, the cross-sectional area of the buffer space of the second cover 216 is A5, and the cross-sectional area of the cooling passage 212*a* is A3, the following equations may be satisfied:

$$A1=A2$$

$$A4=A5$$

$$A1>A3\times n$$ (where $n$ is the number of cooling passages)

To satisfy the above relational expression, the heat exchanger body 210 may be configured such that the cooling fluid is uniformly provided to the plurality of respective cooling passages 212*a*, thereby improving heat transfer efficiency.

The heat sink 220 is installed in the inner diameter portion of the heat exchanger body 210 to be disposed between the heat exchanger body 210 and the discharge pipe 140. As an example, the heat sink 220 may be formed of a material having elasticity to be in close contact with the discharge pipe 140, and may be formed of a material having a relatively high thermal conductivity coefficient. As an example, the heat sink 220 may be formed of a material having a thermal conductivity coefficient similar to a thermal conductivity coefficient of a thermal pad, and may be formed of a material having elasticity similar to elasticity of rubber. For example, the heat sink 220 may be formed of a material containing silicon. The heat sink 220 may also be formed of a material having elasticity to prevent an air layer from being disposed in the space with the discharge pipe 140. If an air layer is disposed between the heat sink 220 and the discharge pipe 140, there may be a problem in that heat transfer efficiency through the heat exchanger body 210 decreases. To prevent this problem, the heat sink 220 of an example embodiment may be formed of a material having elasticity while having a high heat transfer coefficient.

The heat insulator 230 may be disposed to cover the external surface of the heat exchanger body 210, for example, the outer diameter portion. The heat insulator 230 may seal the heat exchanger body 210 to reduce heat exchange with air. As an example, the heat insulator 230 may be formed of fiberglass or a polymer material having a relatively low thermal conductivity. As an example, the heat insulator 230 may be formed of a polymer material having a thermal conductivity coefficient lower than a thermal conductivity coefficient of stainless steel. Accordingly, heat transfer efficiency may be improved in the heat exchanger body 210 while most of the heat is transferred to the discharge pipe 140 side.

The heat exchanger body 210, the heat sink 220, and the heat insulator 230 may be configured such that two pieces cut along the X axis of FIG. 2 to form a pair. In addition, the heat exchanger body 210, the heat sink 220, and the heat insulator 230 may be assembled to the discharge pipe 140 while facing the discharge pipe 140 as a center. In this case, the heat exchanger body 210, the heat sink 220, and the heat insulator 230 may be assembled by, for example, a clamping method, or may be assembled by an adhesive or welding.

As described above, by installing the heat exchanger 200 on the discharge pipe 140, moisture inside the discharge pipe 140 may be reduced. Accordingly, the discharge pipe 140 may be suppressed from being clogged or corroded.

In addition, since the heat exchanger 200 of the example embodiment may be configured such that it does not come into contact with the gas flowing through the discharge pipe 140, corrosion resistance may be secured.

Since the heat exchanger 200 may be freely installed in an arbitary position of the discharge pipe 140, restrictions on the installation location may be removed. Accordingly, maintenance, repair work, and replacement work may be simplified.

Furthermore, since the heat exchanger 200 may be connected to a Power supply Cooling Water System (PCW System), it may not be necessary to configure a separate cooling cycle.

Figure 8:
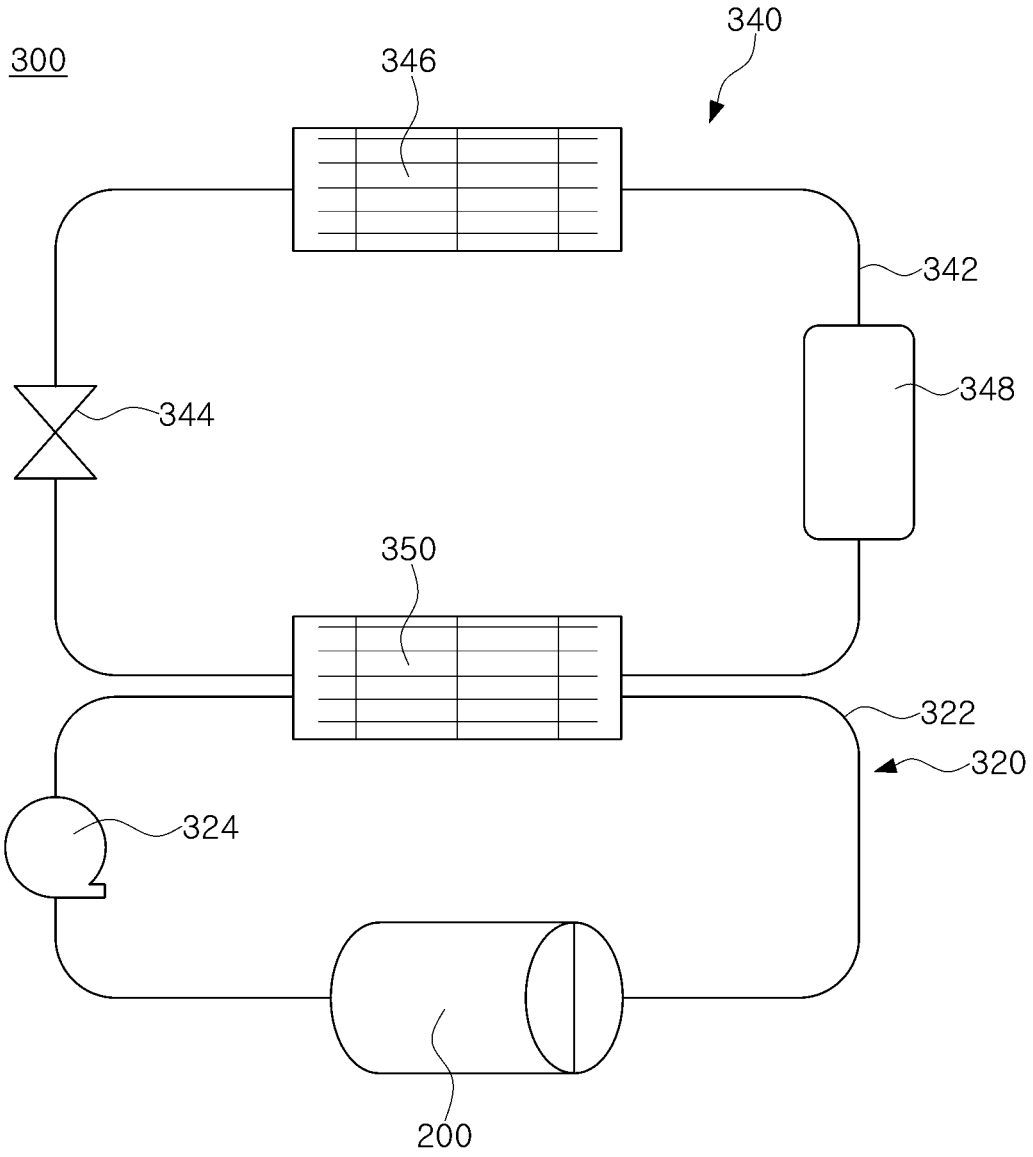
FIG. 8 is a block diagram illustrating a cooling cycle connected to a heat exchanger according to an example embodiment.

FIG. 8 is a block diagram illustrating a cooling cycle connected to a heat exchanger according to an example embodiment.

Referring to FIG. 8, a cooling cycle 300 may include a first cooling cycle 320 and a second cooling cycle 340.

According to an example embodiment, the heat exchanger 200 described above is included in the first cooling cycle 320. The first cooling cycle 320 may include a first circulation pipe 322 through which the cooling fluid circulates, and a pump 324 for compressing the cooling fluid. The heat exchanger 200 may be disposed between a heat exchange unit 350 connected to the first circulation pipe 322 and connected to both a first cooling cycle 320 and a second cooling cycle 340 to be described later, and the pump 324 installed on the first circulation pipe 322. Then, the cooling fluid in the heat exchanger 200 may absorb heat from the discharge pipe 140 (refer to FIG. 1) to remove moisture inside the discharge pipe 140 (refer to FIG. 1) on which the heat exchanger 200 is installed. The cooling fluid circulating in the first cooling cycle 320 and the refrigerant circulating in the second cooling cycle 340 exchange heat in the heat exchange unit 350. In detail, the heat exchange unit 350 is configured to be connected to both the first cooling cycle 320 and the second cooling cycle 340, and the cooling fluid radiates heat to the refrigerant, and the refrigerant absorbs heat from the cooling fluid.

The second cooling cycle 340 may include a second circulation pipe 342 through which the refrigerant circulates, an expansion valve 344 for expanding the refrigerant, a condenser 346 for condensing the refrigerant, and a compressor 348 for compressing the refrigerant. As described above, the heat exchange unit 350 of the example embodiment is also connected to the second circulation pipe 342. The refrigerant of the second cooling cycle 340 serves to cool the cooling fluid through heat exchange with the cooling fluid circulating in the first cooling cycle 320 in the heat exchange unit 350.

In this manner, according to the example embodiment, by configuring a separate cooling cycle 300 connected to the heat exchanger 200 to lower the temperature of the cooling fluid supplied to the heat exchanger 200, heat exchange between the heat exchanger 200 and the discharge pipe 140 may be obtained.

Figure 9:
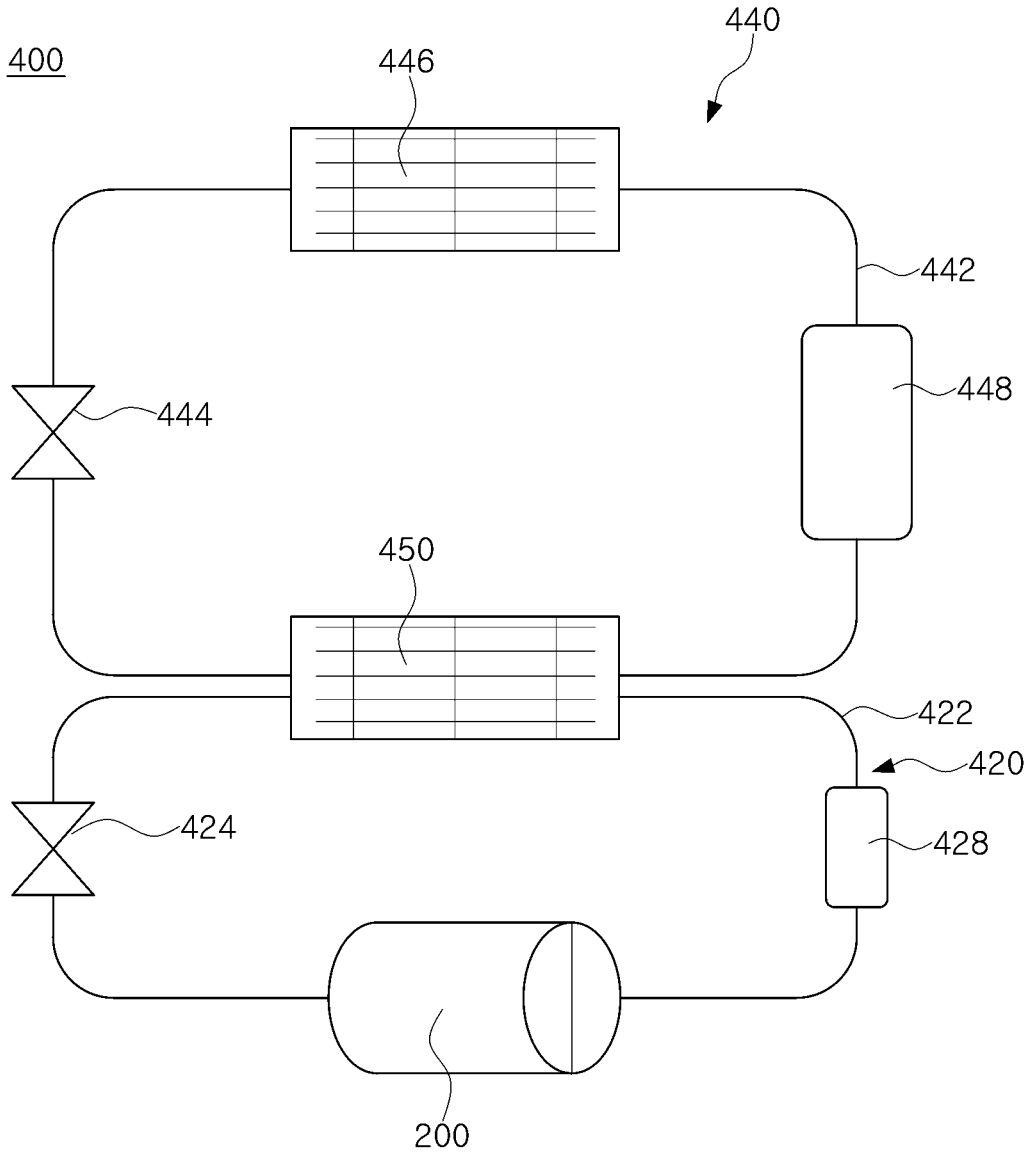
FIG. 9 is a block diagram illustrating a cooling cycle connected to a heat exchanger according to an example embodiment.

FIG. 9 is a block diagram illustrating a cooling cycle connected to a heat exchanger according to an example embodiment.

Referring to FIG. 9, a cooling cycle 400 may include a first cooling cycle 420 and a second cooling cycle 440.

According to an example embodiment, the heat exchanger 200 described above is included in the first cooling cycle 420. The first cooling cycle 420 may include a first circulation pipe 422 through which a cooling fluid circulates, an expansion valve 424 installed in the first circulation pipe 422, a heat exchange unit 450, a compressor 428, and a heat exchanger 200. In addition, the cooling fluid circulating in the first circulation pipe 422 passes through the expansion valve 424, the heat exchange unit 450, the compressor 428 and the heat exchanger 200, and in the heat exchanger 200, absorbs heat from the discharge pipe 140 (refer to FIG. 1) to remove moisture inside the discharge pipe 140 (refer to FIG. 1) in which the heat exchanger 200 is installed.

The second cooling cycle 440 may include a second circulation pipe 442 through which the refrigerant circulates, an expansion valve 444 for expanding the refrigerant, a condenser 446 for condensing the refrigerant, and a compressor 448 for compressing the refrigerant. As described above, the heat exchange unit 450 may also be connected to the second circulation pipe 442. The refrigerant of the second cooling cycle 340 serves to cool the cooling fluid through heat exchange with the cooling fluid circulating in the first cooling cycle 420 in the heat exchange unit 450. In the example embodiment, the heat exchange unit 450 functions as an evaporator in the second cooling cycle 440, and functions as a condenser in the first cooling cycle 420.

In this manner, in the example embodiment, by configuring a separate cooling cycle 300 connected to the heat exchanger 200 to lower the temperature of the cooling fluid supplied to the heat exchanger 200, heat exchange between the heat exchanger 200 and the discharge pipe 140 maybe obtained.

As set forth above, example embodiments of a scrubbing apparatus capable of performing dehumidification inside the discharge pipe to prevent the discharge pipe from being clogged may be provided.

In addition, according to example embodiments, a scrubbing apparatus capable of preventing accelerated corrosion of the discharge pipe in a certain area of the discharge pipe may be provided.

While aspects of example embodiments have been particularly shown and described, it will be understood that various changes in form and details may be made therein without departing from the spirit and scope of the following claims.

What is claimed is:

1. A scrubbing apparatus comprising:

a reactor comprising an interior space;

a burner disposed in the interior space of the reactor and configured to burn waste gas;

a water tower connected to the reactor and configured to remove harmful substances from combusted gas;

a discharge pipe connected to an upper end of the water tower, through which a fluid discharged from the water tower is configured to flow; and a heat exchanger surrounding the discharge pipe and configured to remove moisture from an inside of the discharge pipe, wherein the heat exchanger comprises:

a heat exchanger body comprising a cooling passage through which a cooling fluid performing heat exchange with the fluid flowing through the discharge pipe is configured to flow;

a heat sink disposed between the heat exchanger body and the discharge pipe and in close contact with an external surface of the discharge pipe; and an insulator surrounding at least a portion of an external surface of the heat exchanger body.

2. The scrubbing apparatus of claim 1, wherein the heat exchanger body comprises a body portion provided with the cooling passage, a first cover disposed on a first end of the body portion and comprising an inlet, and a second cover disposed on a second end of the body portion and comprising an outlet.

3. The scrubbing apparatus of claim 2, wherein the cooling passage comprises a plurality of cooling passages extending in a longitudinal direction of the body portion and spaced apart from each other in a circumferential direction.

4. The scrubbing apparatus of claim 2, wherein the first cover comprises a buffer space through which the cooling fluid introduced through the inlet is uniformly supplied to the cooling passage.

5. The scrubbing apparatus of claim 2, wherein the second cover comprises a buffer space through which the cooling fluid flowing out through the outlet flows out uniformly.

6. The scrubbing apparatus of claim 1, wherein the heat sink comprises a material having elasticity and a high thermal conductivity coefficient.

7. The scrubbing apparatus of claim 6, wherein the heat sink comprises a material containing silicon.

8. The scrubbing apparatus of claim 1, wherein the heat exchanger body comprises an aluminum material.

9. The scrubbing apparatus of claim 1, wherein the insulator comprises at least one of a fiberglass or a polymer material having a thermal conductivity coefficient lower than a thermal conductivity coefficient of stainless steel.

10. The scrubbing apparatus of claim 1, wherein when a number of the cooling passage of the heat exchanger body is n, a radius of the cooling passage is r, and a radius of an inner diameter of the heat exchanger body is R, $R<nr/2$ ($5\leq n\leq 20$) is satisfied.

11. The scrubbing apparatus of claim 2, wherein the inlet and the outlet are connected to a power supply cooling water system used in semiconductor equipment.

12. The scrubbing apparatus of claim 1, further comprising a cooling cycle, wherein the cooling cycle comprises a first cooling cycle and a second cooling cycle, wherein the heat exchanger is connected to the first cooling cycle, and wherein a refrigerant which is configured to perform heat exchange with the cooling fluid circulating in the first cooling cycle, is configured to circulate in the second cooling cycle.

13. The scrubbing apparatus of claim 12, wherein the cooling cycle comprises a heat exchange unit which is connected to both the first cooling cycle and the second cooling cycle and in which heat is exchanged between the cooling fluid and the refrigerant.

14. The scrubbing apparatus of claim 1, wherein the heat exchanger comprises a tube shape corresponding to a shape of the discharge pipe.

15. A scrubbing apparatus comprising:

a reactor comprising an interior space;

a burner disposed in the interior space of the reactor and configured to burn waste gas;

a water tower connected to the reactor and configured to remove harmful substances from combusted gas;

a discharge pipe connected to an upper end of the water tower; and a heat exchanger comprising a tube shape corresponding to a shape of the discharge pipe and surrounding the discharge pipe, wherein the heat exchanger comprises:

a heat exchanger body comprising a cooling passage through which a cooling fluid performing heat exchange with a fluid flowing through the discharge pipe is configured to flow;

a heat sink disposed between the heat exchanger body and the discharge pipe and in close contact with an external surface of the discharge pipe; and an insulator surrounding at least a portion of an external surface of the heat exchanger body, and wherein a number of the cooling passage of the heat exchanger body is n, a radius of the cooling passage is r, and a radius of an inner diameter of the heat exchanger body is R, $R<nr/2$ ($5\leq n\leq 20$) is satisfied.

16. The scrubbing apparatus of claim 15, wherein the heat exchanger body comprises:

a body portion provided with the cooling passage;

a first cover disposed on a first end of the body portion and comprising an inlet; and a second cover disposed on a second end of the body portion and comprising an outlet.

17. The scrubbing apparatus of claim 16, wherein the cooling passage comprises a plurality of cooling passages extending in a longitudinal direction of the body portion and spaced apart from each other in a circumferential direction.

18. The scrubbing apparatus of claim 16, wherein the first cover comprises a buffer space through which the cooling fluid introduced through the inlet is uniformly supplied to the cooling passage.

19. A scrubbing apparatus comprising:

a reactor comprising an interior space;

a burner disposed in the interior space of the reactor and configured to burn waste gas;

a water tower connected to the reactor and configured to remove harmful substances from combusted gas;

a discharge pipe connected to an upper end of the water tower; and a heat exchanger surrounding the discharge pipe, wherein the heat exchanger comprises:

a heat exchanger body comprising a plurality of cooling passages extending in a longitudinal direction and spaced apart from each other in a circumferential direction;

a heat sink disposed between the heat exchanger body and the discharge pipe; and an insulator surrounding at least a portion of an external surface of the heat exchanger body.

20. The scrubbing apparatus of claim 19, wherein when the heat exchanger body further comprises an inlet and an outlet;

wherein when a cross-sectional area of the inlet is A1, a cross-sectional area of each of the plurality of cooling passages is A3, and a number of the plurality of cooling passages is n, then $A1>A3\times n$.

* * * * *